US007758401B2

(12) United States Patent
Kelley et al.

(10) Patent No.: US 7,758,401 B2
(45) Date of Patent: Jul. 20, 2010

(54) UPPER SUPPORT GARMENT HAVING AN IMPROVED BACK

(75) Inventors: Rick Kelley, Germanton, NC (US); Roxana Avalos-Dessner, Dobbs Ferry, NY (US); Victoria Dekoster, New Rochelle, NY (US); Roger D Warren, Claremont, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 521 days.

(21) Appl. No.: 11/634,661

(22) Filed: Dec. 6, 2006

(65) Prior Publication Data

US 2008/0139084 A1 Jun. 12, 2008

(51) Int. Cl.
*A41C 3/00* (2006.01)

(52) U.S. Cl. ..... 450/92; 450/39; 450/93

(58) Field of Classification Search ..... 450/92, 450/93, 39

See application file for complete search history.

(56) References Cited

U.S. PATENT DOCUMENTS

| | | | |
|---|---|---|---|
| 342,309 | A | 5/1886 | Stout |
| 1,510,428 | A | 9/1924 | Agnes |
| 1,875,201 | A | 8/1932 | Weber |
| 2,497,938 | A | 2/1950 | Werther |
| 2,794,986 | A | 6/1957 | Milo |
| 2,800,659 | A | 7/1957 | Hazard |
| 2,866,462 | A | 12/1958 | Faron |
| 2,888,931 | A | 6/1959 | Schaumer |
| 3,116,735 | A | 1/1964 | Geimer |
| 3,554,190 | A | 1/1971 | Kaplin |
| 4,741,719 | A | 5/1988 | Wirth |
| 4,804,351 | A | 2/1989 | Raml et al. |
| 4,816,005 | A | 3/1989 | Braaten |
| 5,154,659 | A | 10/1992 | Gluckin |
| 5,385,502 | A | 1/1995 | Moretz et al. |
| 5,441,436 | A | 8/1995 | Moretz et al. |
| D381,188 | S | 7/1997 | Allen |
| 5,643,043 | A | 7/1997 | Pflum |
| 5,820,443 | A | 10/1998 | Burr |
| 5,823,851 | A | 10/1998 | Dicker |
| 5,916,829 | A * | 6/1999 | Girard et al. ..... 442/244 |
| 6,068,538 | A | 5/2000 | Alleyene |
| 6,168,498 | B1 | 1/2001 | Wagner |
| D475,506 | S | 6/2003 | Hoffman et al. |
| D475,835 | S | 6/2003 | Hoffman et al. |
| 6,645,040 | B2 | 11/2003 | Rabinowicz et al. |
| 6,645,041 | B2 | 11/2003 | Sorensen |
| 6,769,358 | B2 | 8/2004 | Jordan |

(Continued)

FOREIGN PATENT DOCUMENTS

| | | |
|---|---|---|
| EP | 1123666 | 8/2001 |

(Continued)

*Primary Examiner*—Gloria Hale
(74) *Attorney, Agent, or Firm*—Womble Carlyle Sandridge & Rice, PLLC

(57) ABSTRACT

An upper support garment having a back portion comprising an inner fabric layer, an outer fabric layer, and an adhesive applied between the inner and outer fabric layers to connect together the inner and outer fabric layers. The inner fabric layer has a pair of cutouts therethrough and the adhesive layer has an identical pair of cutouts. The pair of cutouts of the inner fabric layer are positioned to correspond to the back muscles of a wearer.

20 Claims, 5 Drawing Sheets

U.S. PATENT DOCUMENTS

| | | | |
|---|---|---|---|
| 6,899,590 | B2 | 5/2005 | Luk |
| 6,966,815 | B2 | 11/2005 | Weinerth |
| D523,212 | S | 6/2006 | Iourina |
| 7,060,157 | B1 | 6/2006 | Bauer et al. |
| 7,077,720 | B2 | 7/2006 | Schneider et al. |
| 7,081,035 | B2 | 7/2006 | Kawakami |
| 7,083,494 | B2 | 8/2006 | Sandroussi et al. |
| 2002/0022433 | A1 | 2/2002 | Yeung et al. |
| 2005/0101221 | A1 | 5/2005 | Abbey et al. |
| 2005/0255789 | A1 | 11/2005 | Gaudet et al. |
| 2006/0025039 | A1 | 2/2006 | Barbour et al. |
| 2006/0105673 | A1 | 5/2006 | Lau |
| 2006/0135318 | A1 | 6/2006 | Huang et al. |
| 2006/0141905 | A1 | 6/2006 | Lau |

FOREIGN PATENT DOCUMENTS

| | | |
|---|---|---|
| EP | 1226767 | 7/2002 |

* cited by examiner

UPPER SUPPORT GARMENT HAVING AN IMPROVED BACK

BACKGROUND OF THE INVENTION

1. Field of the Invention

The present invention generally relates to an upper support garment having an improved back. More particularly, the present invention relates to an upper support garment, such as a brassiere, having an improved back that provides improved support while still allowing for flexibility or power for the brassiere back.

2. Description of the Related Art

A wide variety of upper support garments, in particular brassieres, have been developed. Such support garments are designed to provide support for the wearer's breasts, especially during exercise and other daily activities. Unfortunately, certain muscles of the wearer are not reinforced, especially those in the back area and under the arms and shoulders of the wearer.

Accordingly, there is a need for a support garment or brassiere that provides the desired unified torso support while still allowing for flexibility, especially in the back area and under the arms and shoulders of the wearer, so that the muscles of the wearer in that area are permitted to move relatively unimpeded. Such complete torso support produces power in the brassiere back.

BRIEF SUMMARY OF THE INVENTION

The present disclosure provides an upper support garment or brassiere that has an improved back to the brassiere.

The present disclosure also provides such a brassiere in which the back has support and improved flexibility thereby resulting in improved power in the brassiere back.

The present disclosure further provides such a brassiere in which the back is made of two fabric layers, an inner layer and an outer layer, in which the inner layer has selected openings for flexibility and movement of the muscles of the wearer.

These and other advantages and benefits of the present disclosure are achieved by a back portion of a brassiere or other upper support garment in which the back portion comprises an inner layer or panel of fabric, an outer layer or panel of fabric and an adhesive applied therebetween to join the two fabric layers together. The adhesive is preferably applied to the inner fabric layer as a dot-coated adhesive, or a net adhesive wet laminated to the layer. One of the two fabric layers, preferably the inner fabric layer, has two partial cutouts or windows. Preferably, these two cutouts are oblong cutouts, and are symmetrically oriented with respect to a vertical centerline of the back portion and at an angle with respect to a bottom edge of the back portion. This oblong shape and the positioning of same in the back of the brassiere correspond to the back muscles of the wearer. The shape and/or positioning of the cutouts may correspond to the trapezius muscles of a wearer, and/or the latissimus dorsi muscles of a wearer.

The present disclosure also provides for a method of making the back portion of a brassiere or upper support garment. The method includes the steps of: cutting inner layer blocker and outer layer blocker to a shape, preferably a hexagonal shape; applying adhesive to inner layer blocker; cutting cutouts or windows into and entirely through inner layer blocker so that the fabric and adhesive are removed in the cutout; laminating together inner layer blocker and outer layer blocker; and cutting the combined inner and outer layer blockers to the final shape of the back portion.

DETAILED DESCRIPTION OF THE INVENTION

Figure 1:
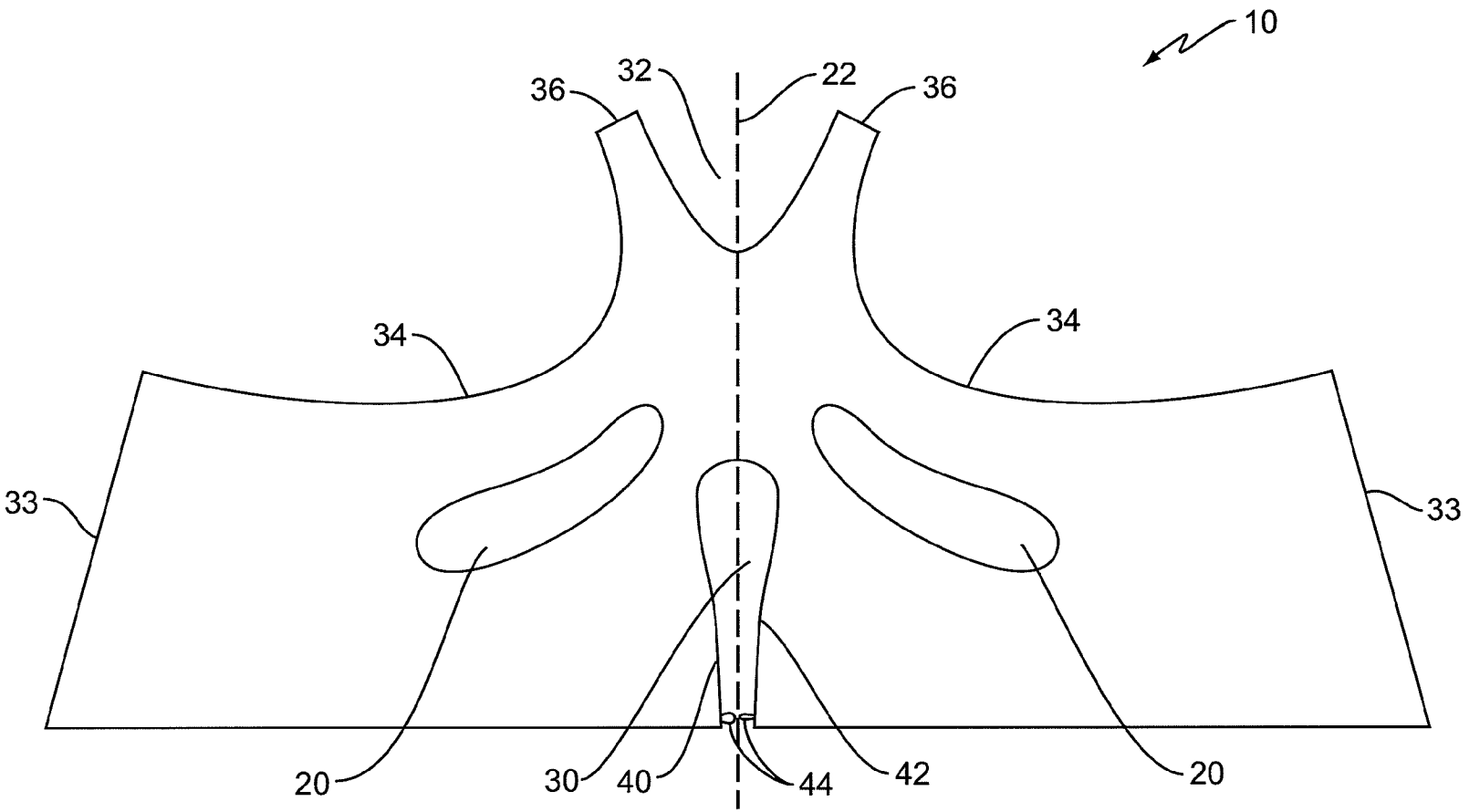
FIG. 1 is a plan view of a back portion of an upper support garment or brassiere according to the present disclosure.

Referring to the drawings and, in particular, to FIG. 1, there is provided an exemplary embodiment of a back portion generally represented by reference numeral 10 of a support garment or brassiere. In one preferred embodiment, the shape of back portion 10 is an x-shape or racer back shape. The back portion 10 has an upper section 32 with a pair of upper portions 36 that connect to a pair of shoulder straps for the brassiere, a lower section that has a pair of top edges 34 that are positioned under the arms and shoulders of the wearer, and sides 33 connected to the cup portions of the brassiere.

The back portion 10 may form part of any suitable upper support garment. Such garments include a brassiere, a sports bra, a t-shirt, a tank-top, a bra liner, and a bathing suit. In one preferred embodiment, back portion 10 forms a part of a pull-over racer back bra.

The formed back portion 10 has two cutouts 20 in one of the two layers of the formed back portion. In one preferred embodiment, back portion 10 forms a part of a pull-over bra and includes a keyway 30 formed entirely through the back portion.

The back portion 10 has a first inner edge 40 and a second inner edge 42. The brassiere having the back portion 10 of the present disclosure is intended not to have a completely open area. Accordingly, the brassiere in this embodiment will be placed over the head and shoulders onto the torso of the wearer for placement on the wearer and removal from the wearer. Because a wearer's shoulders will generally be wider than the wearer's torso, and in order to have the brassiere fit properly when on the wearer, there is a need for some mechanism to provide a more secure fit. The keyway 30 in combination with adjustment mechanism 44, such as a hook and eye fastener or a velcro fastener, removably connects the first inner edge 40 and the second inner edge 42, preferably at the lowest point of the free end of the keyway 30. Preferably, the mechanism 44 is an adjustable hook and eye mechanism.

Figure 2A:
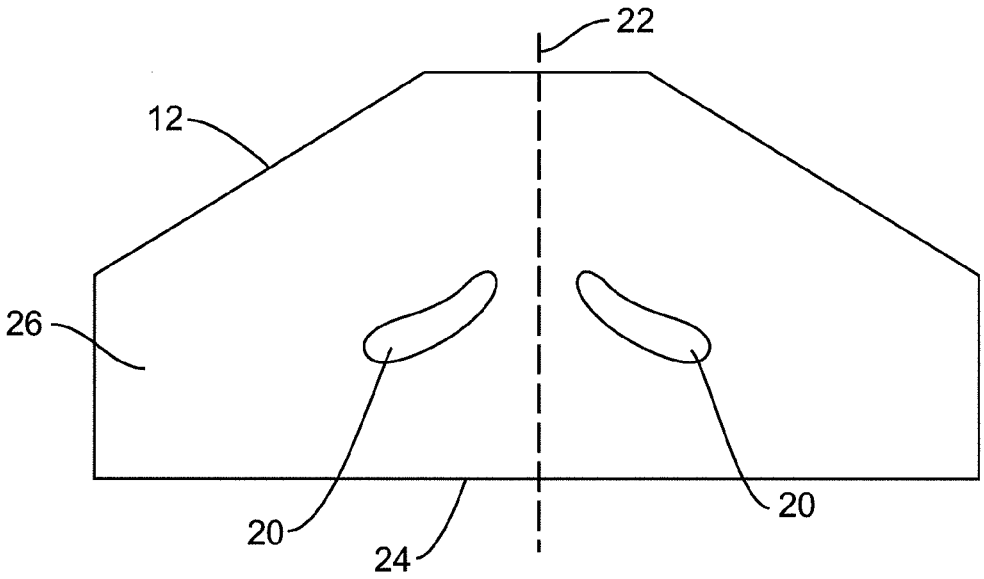
FIG. 2*a* is a plan view of an inner fabric layer or panel blocker of the back portion of FIG. 1.
Figure 2B:
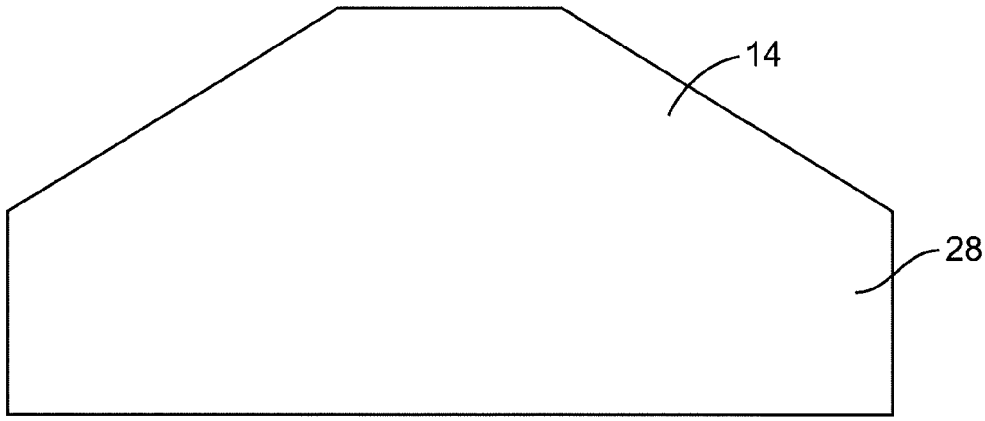
FIG. 2*b* is a plan view of an outer fabric layer or panel blocker of the back portion of FIG. 1.
Figure 5:
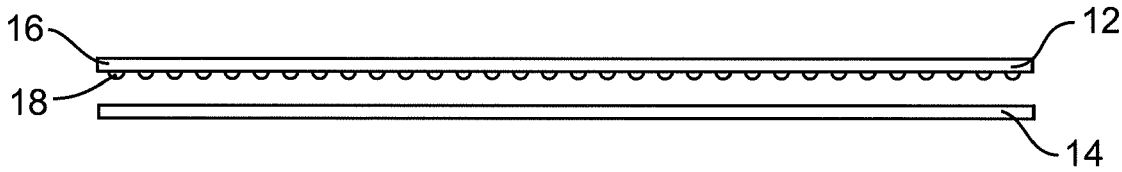
FIG. 5 is a top view of the combining step of FIG. 4, showing the adhesive between the inner fabric layer and the outer fabric layer.

Referring to FIGS. 2*a* and 2*b*, back portion 10 has two fabric layers or panels, namely an inner fabric layer 12 and an outer fabric layer 14, respectively. The inner fabric layer 12 and the outer fabric layer 14 can be any known fabric material used in an upper support garment, especially a brassiere. Preferably, the inner fabric layer 12 and the outer fabric layer 14 are made of the same fabric material, however, they can be made of different materials. More preferably, the inner fabric layer 12 and the outer fabric layer 14 are made of a fabric material comprising nylon and spandex. Most preferably, inner fabric layer 12 and outer fabric layer 14 are made of a fabric material comprising approximately 76% nylon and approximately 24% spandex. One of the fabric layers, preferably inner fabric layer 12, is a sandwich that includes, as shown in FIG. 5, fabric 16 and an adhesive or adhesive layer 18. It should be understood that the adhesive could be applied or laminated to the outer fabric layer 14. However, it might not be practical since in the cutout area both inner fabric layer as well as all the adhesive are removed in order to provide more flexibility and thus the adhesive 18 should be on the removed or cutout fabric.

As shown in FIGS. 2*a* and 2*b*, back portion 10 comprises inner panel 12 with the pair of cutouts 20. The cutouts 20 allow for flexibility and comfort of the brassiere or upper support garment. In one preferred embodiment, cutouts 20 comprise two oblong cutouts that are substantially symmetrically oriented with respect to a vertical centerline 22 of back portion 10. Vertical centerline 22 is preferably substantially aligned with the spine of a wearer. Cutouts 20 may be of any size and shape suitable for enhancing comfort and flexibility of the support garment. Preferably, cutouts are shaped to maximize movement of the muscles of a wearer's back and/or the muscles of the area under a wearer's arm and shoulders, allowing for natural movement and flexibility along the lines of cutouts 20 while still providing sufficient support in other areas of back portion 10. In one preferred embodiment, cutouts 20 are strategically positioned to allow stretch to the muscles of the back of a user, such as the trapezius muscles and/or the latissimus dorsi muscles. Cutouts 20 may correspond to one or more muscles in the back of a user. In another preferred embodiment, cutouts 20 are positioned at an angle with respect to a bottom edge 24 of inner panel 12. In these embodiments, cutouts 20 are preferably oblong with rounded ends, which simplifies cutting of cutouts 20 during the manufacturing process. In another embodiment, cutouts 20 are kidney-shaped.

Although the exemplary embodiment shown in FIGS. 1 and 2*a*, shows back portion 10 with two cutouts 20, the back portion may have any number of cutouts, and may be located in other locations in the back portion. For example, cutouts may be included in the area of upper portions 36 of back portion 10. Moreover, each cutout 20 may be two or more, or a series, of cutouts. The two or more cutouts would preferably be selected in position and shape to complement the muscles of the wearer. The cutouts 20 provide for less fabric material in the back portion 10 so that the muscles have the ability to move normally with less impedance by the back portion. In addition, the cutouts are in the inner fabric layer 12 with the cutouts preferably in contact with the torso of the wearer to permit the muscles of the torso to expand during movement. Thus, the back portion 10 permits the power of the back muscles of the wearer to perform naturally.

Figure 3A:
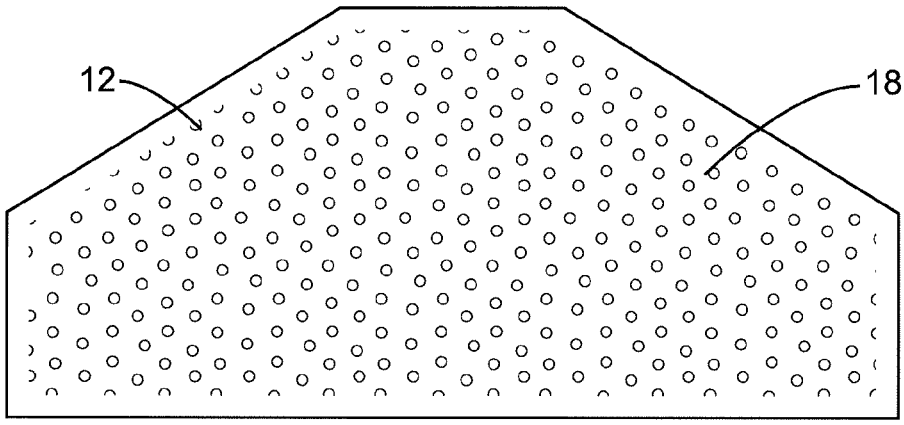
FIG. 3*a* is a plan view of the inner fabric layer, prior to any cutout, with a dot-coated adhesive thereon of the back portion of FIG. 1.
Figure 3B:
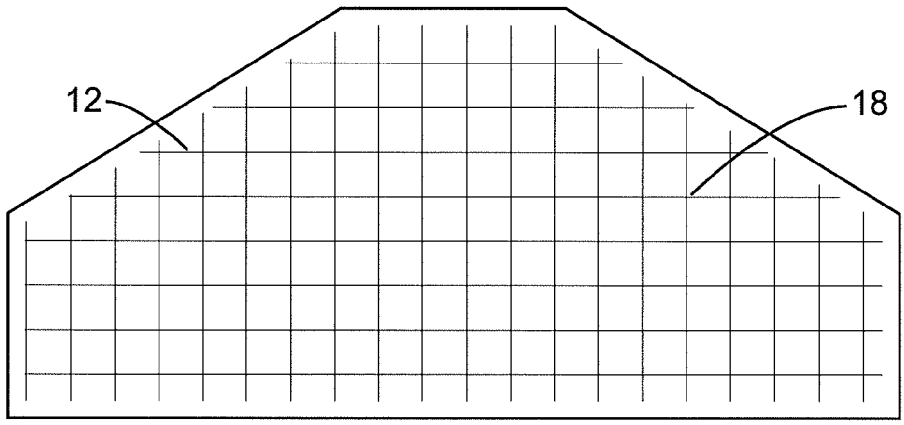
FIG. 3*b* is a plan view of the inner fabric layer, prior to any cutout, with a net adhesive thereon of the back portion of FIG. 1.

Adhesive layer 18 is preferably a dot-coated adhesive layer, illustrated in FIG. 3*a*. Alternatively, adhesive layer 18 can be a net adhesive layer wet laminated to inner fabric layer 12, as illustrated in FIG. 3*b*. The dot adhesive is preferably a Del Star Technologies adhesive. Such an adhesive is a high density polyethylene (HDPE) adhesive that has a MD tensile of 4.0 lbs/inch and a CD tensile of 3.7 lbs/inch with a melting point of 135 degrees Celsius and a processing range of less than 165 degrees Celsius.

Referring to FIGS. 3*a* and 3*b*, the presence of adhesive layer 18 decreases the modulus of elasticity of both inner fabric layer 12 and outer fabric layer 14. After assembly, back portion 10 comprises three layers in the majority of the back portion 10, namely outer fabric layer 14, inner fabric layer 12, and adhesive or adhesive layer 18. However, the areas of back portion 10 corresponding to cutouts 20 have only a single fabric layer, namely outer fabric layer 14 since both the inner fabric layer 12 and the adhesive layer 18 are absent. The adhesive layer is preferably initially positioned onto the inner fabric layer to facilitate this removal of both the inner fabric layer 12 and the adhesive layer 18.

Thus, the areas in the back portion 10 that are joined by adhesive layer 18 provide greater reinforcement and support to a wearer's body, while the areas defined by cutouts 20 provide for greater give or flexibility. Advantageously, back portion 10 is able to provide advanced support while also providing sufficient flexibility. This greatly increases the efficacy of the support garment.

Figure 4:
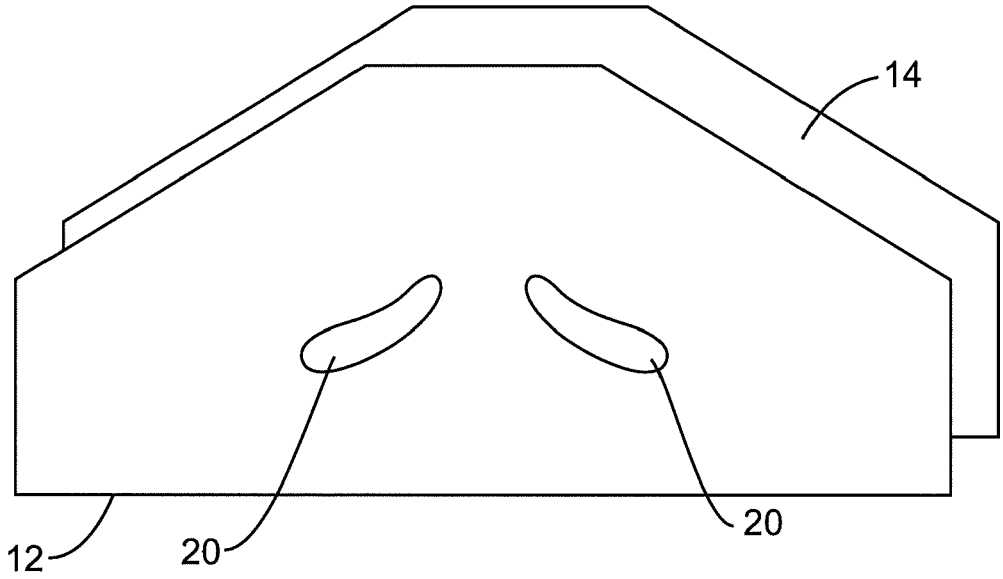
FIG. 4 is a schematic view of a step of combining the inner fabric layer with the outer fabric layer.
Figure 6:
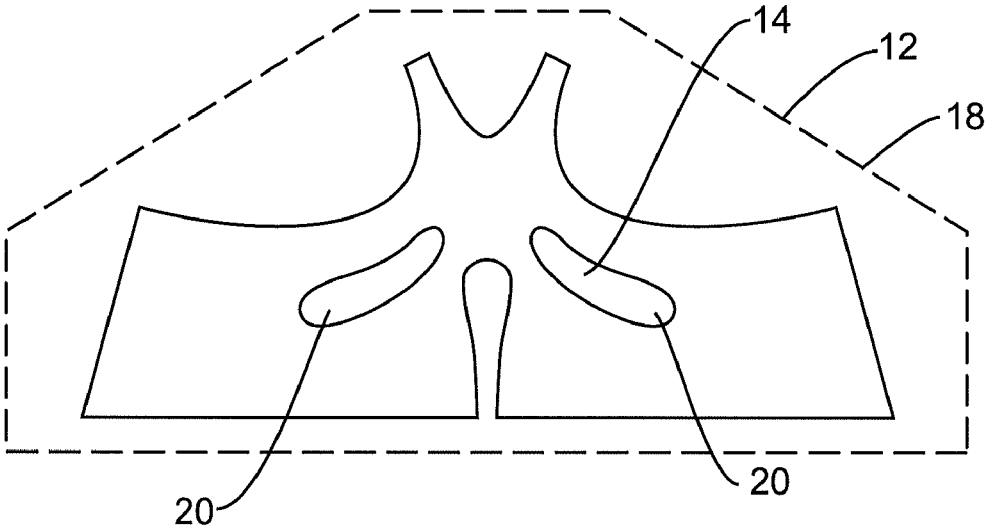
FIG. 6 illustrates the step of cutting the fabric layers to produce the final shape of the back portion of FIG. 1.

The present disclosure also covers the method of manufacturing back portion 10. In a preferred method, there is a step of cutting inner layer blocker 26 and outer layer blocker 28 to shape, preferably a hexagonal shape, as shown in FIGS. 2*a* and 2*b*. Blockers 26, 28 are preferably cut, preferably by any known mechanical means, to substantially the same shape. Then, adhesive layer 18 is applied to inner layer blocker 26 by any suitable process. Preferably, adhesive layer 18 is an adhesive layer that is dot-coated onto inner layer blocker 26, as illustrated in FIG. 3*a*. Alternatively, adhesive layer 18 is a net adhesive that is wet laminated to inner layer blocker 26, as illustrated in FIG. 3*b*. Next, windows or cutouts 20 are cut into and entirely through inner layer blocker 26 so that the fabric and adhesive are removed in the cutout. Preferably, cutouts 20 are cut into inner layer blocker 26. Inner layer blocker 26 is then placed on top of outer layer blocker 28, with adhesive layer 18 facing the outer layer blocker 28, as illustrated in FIGS. 4 and 5. Inner layer blocker 26 and outer layer blocker 28 are then laminated together. Finally, the combined blockers 26, 28 are cut out to form the final shape of back portion 10, as shown in FIG. 6.

While the present invention has been described with reference to one or more exemplary embodiments, it will be understood by those skilled in the art that various changes may be made and equivalents may be substituted for elements thereof without departing from the scope of the present invention. In addition, many modifications may be made to adapt a particular situation or material to the teachings of the disclosure without departing from the scope thereof. It is intended that the present disclosure not be limited to the particular embodiment(s) disclosed as the best mode contemplated, but that the disclosure will include all embodiments falling within the scope of the appended claims.

The invention claimed is:

1. A back portion for an upper torso support garment, the back portion comprising:

a band for encircling the back upper torso of a wearer and comprising opposed ends for interconnection to upper torso support garment breast cups, and comprising:

an inner fabric layer for wear adjacent the skin of the wearer;

an outer fabric layer;

an adhesive interconnecting the inner and outer fabric layers; and a pair of shaped cutouts formed through only the inner fabric layer, the cutouts being substantially symmetrically oriented with respect to a vertical centerline of the back portion and adjacent at least one of the trapezius and latissimus dorsi muscles of the wearer.

2. The back portion of claim 1, wherein the upper torso support garment is a brassiere.

3. An upper torso support garment having a back portion, comprising:

a front portion including a pair of breast cups;

a band for encircling the back upper torso of a wearer and comprising opposed ends for interconnection to the upper torso support garment breast cups, and comprising:

an inner fabric layer for wear adjacent the skin of the wearer;

an outer fabric layer;

an adhesive interconnecting the inner and outer fabric layers; and a pair of shaped cutouts formed through only the inner fabric layer, the cutouts being substantially symmetrically oriented with respect to a vertical centerline of the back portion and adjacent at least one of the trapezius and latissimus dorsi muscles of the wearer.

4. The upper torso support garment of claim 3, wherein each of the pair of cutouts of the inner fabric layer is oblong.

5. The upper torso support garment of claim 3, wherein the upper torso support garment is a brassiere.

6. The upper torso support garment of claim 3, wherein the adhesive is a dot-coated adhesive.

7. The upper torso support garment of claim 6, wherein the dot-coated adhesive is a high-density polyethylene.

8. The upper torso support garment of claim 7, wherein the high-density polyethylene adhesive has a MD tensile of 4.0 lbs/in. and a CD tensile of 3.7 lbs/in.

9. The upper torso support garment of claim 3, wherein the adhesive layer is a net adhesive layer.

10. A method of making a back portion of an upper torso support garment, including the steps of:

cutting an inner layer blocker and an outer layer blocker to a shape;

applying adhesive to the inner layer blocker;

forming cutouts through the inner layer blocker and adhesive that are substantially symmetrically oriented with respect to a vertical centerline of the back portion and adjacent at least one of the trapezius and latissimus dorsi muscles of the wearer;

adhering together the inner layer blocker and outer layer blocker to form an assembly; and cutting the assembly into a band for encircling the back upper torso of a wearer and comprising opposed ends for interconnection to upper torso support garment breast cups.

11. The method of claim 10, wherein the step of cutting comprises cutting the inner layer blocker and the outer layer blocker to a hexagonal shape.

12. The method of claim 10, wherein applying the adhesive comprises applying dot-coating onto the inner layer blocker.

13. The method of claim 12, wherein the dot-coated adhesive is a high-density polyethylene.

14. The method of claim 10, wherein applying the adhesive is applying a net adhesive that is wet laminated to the inner layer blocker.

15. The method of claim 10, wherein the upper support garment is a brassiere.

16. The back portion of claim 1, wherein each of the pair of cutouts of the inner fabric layer is oblong.

17. The back portion of claim 1, wherein the adhesive is a dot-coated adhesive.

18. The back portion of claim 17, wherein the dot-coated adhesive is a high-density polyethylene.

19. The back portion of claim 18, wherein the high-density polyethylene adhesive has a MD tensile of 4.0 lbs/in. and a CD tensile of 3.7 lbs/in.

20. The back portion of claim 1, wherein the adhesive layer is a net adhesive layer.

* * * * *